US011457664B2

(12) United States Patent
Aoun et al.

(10) Patent No.: US 11,457,664 B2
(45) Date of Patent: Oct. 4, 2022

(54) APPARATUS FOR HEATING SMOKABLE MATERIAL

(71) Applicant: BRITISH AMERICAN TOBACCO (INVESTMENTS) LIMITED, London (GB)

(72) Inventors: Walid Abi Aoun, London (GB); David Paton, London (GB)

(73) Assignee: Nicoventures Trading Limited, London (GB)

( * ) Notice: Subject to any disclaimer, the term of this patent is extended or adjusted under 35 U.S.C. 154(b) by 459 days.

(21) Appl. No.: 16/311,405

(22) PCT Filed: Jun. 27, 2017

(86) PCT No.: PCT/EP2017/065906
§ 371 (c)(1),
(2) Date: Dec. 19, 2018

(87) PCT Pub. No.: WO2018/002083
PCT Pub. Date: Jan. 4, 2018

(65) Prior Publication Data

US 2020/0229497 A1 Jul. 23, 2020

Related U.S. Application Data

(60) Provisional application No. 62/356,343, filed on Jun. 29, 2016.

(51) Int. Cl.
*H05B 6/10* (2006.01)
*A24F 40/465* (2020.01)
(Continued)

(52) U.S. Cl.
CPC ..... *A24F 40/465* (2020.01); *A24F 40/46* (2020.01); *A24F 40/57* (2020.01); *H05B 1/0297* (2013.01);
(Continued)

(58) Field of Classification Search
CPC ..... A24F 40/10; A24F 40/20; A24F 40/30; A24F 40/44; A24F 40/46; A24F 40/465;
(Continued)

(56) References Cited

U.S. PATENT DOCUMENTS 2,592,554 A 4/1952 Frankenburg
2,860,638 A 11/1958 Frank et al.
(Continued)

FOREIGN PATENT DOCUMENTS

AU 2014369867 A1 6/2016
AU 2017289114 B2 4/2020
(Continued)

OTHER PUBLICATIONS

International Search Report and Written Opinion, Application No. PCT/EP2017/065906, dated Oct. 24, 2017, 16 pages.
(Continued)

*Primary Examiner* — Hung D Nguyen
(74) *Attorney, Agent, or Firm* — Patterson Thuente Pedersen P.A.

(57) ABSTRACT

Disclosed is an apparatus for heating smokable material to volatilize at least one component of the smokable material. The apparatus includes a heating zone for receiving at least a portion of an article including smokable material; an outlet for permitting volatilized components of the smokable material to pass from the heating zone towards an exterior of the apparatus when the article is heated in the heating zone in use; a heating element that is heatable by penetration with a varying magnetic field to heat the heating zone, wherein a first section of the heating element is located between a second section of the heating element and the outlet, and wherein the second section of the heating element is heatable in use by thermal conduction from the first section of the heating element; and a magnetic field generator for
(Continued)

generating a varying magnetic field that penetrates the first section of the heating element and avoids the second section of the heating element.

19 Claims, 2 Drawing Sheets

(51) Int. Cl.

| | |
|---|---|
| ***A24F 40/46*** | (2020.01) |
| ***A24F 40/57*** | (2020.01) |
| ***H05B 1/02*** | (2006.01) |
| ***H05B 6/02*** | (2006.01) |
| ***H05B 6/06*** | (2006.01) |
| ***H05B 6/36*** | (2006.01) |
| ***H05B 6/40*** | (2006.01) |
| ***H05B 6/00*** | (2006.01) |
| ***H05B 6/38*** | (2006.01) |
| *A24F 40/20* | (2020.01) |

(52) U.S. Cl.
CPC ..... *H05B 6/00* (2013.01); *H05B 6/02* (2013.01); *H05B 6/06* (2013.01); *H05B 6/36* (2013.01); *H05B 6/38* (2013.01); *H05B 6/40* (2013.01); *A24F 40/20* (2020.01)

(58) Field of Classification Search
CPC ..... A24F 40/50; A24F 40/51; A24F 40/57; A24F 47/004; A24F 47/008; H05B 1/0297; H05B 1/0244; H05B 6/00; H05B 6/02; H05B 6/04; H05B 6/06; H05B 6/105; H05B 6/108; H05B 6/36; H05B 6/365; H05B 6/38; H05B 6/40; H05B 6/44
USPC ..... 219/628, 629, 634, 520, 521, 533, 541; 392/386, 387, 388, 390, 395, 404, 405, 392/406; 131/194, 328, 329, 335
See application file for complete search history.

(56) References Cited

U.S. PATENT DOCUMENTS

| | | | |
|---|---|---|---|
| 3,065,756 | A | 11/1962 | Noel et al. |
| 3,144,174 | A | 8/1964 | Henry et al. |
| 3,173,612 | A | 3/1965 | Gut et al. |
| 3,517,151 | A | 6/1970 | Mekjean et al. |
| 3,596,034 | A | 7/1971 | Mekjean |
| 4,149,548 | A | 4/1979 | Bradshaw |
| 4,913,168 | A | 4/1990 | Potter et al. |
| 4,944,317 | A | 7/1990 | Thal |
| 5,093,894 | A | 3/1992 | Deevi et al. |
| 5,144,962 | A | 9/1992 | Counts et al. |
| 5,317,132 | A | 5/1994 | Clough et al. |
| 5,369,249 | A | 11/1994 | Kwon |
| 5,613,505 | A | 3/1997 | Campbell et al. |
| 5,649,554 | A | 7/1997 | Sprinkel et al. |
| 6,053,176 | A | 4/2000 | Adams et al. |
| 6,803,550 | B2 | 10/2004 | Sharpe et al. |
| 7,185,659 | B2 | 3/2007 | Sharpe |
| 7,185,959 | B2 | 3/2007 | Mueller et al. |
| 7,810,505 | B2 | 10/2010 | Yang |
| 8,459,271 | B2 | 6/2013 | Inagaki |
| 8,807,140 | B1 | 8/2014 | Scatterday |
| 8,910,640 | B2 | 12/2014 | Sears et al. |
| 9,357,803 | B2 | 6/2016 | Egoyants et al. |
| 9,554,598 | B2 | 1/2017 | Egoyants et al. |
| 9,980,512 | B2 | 5/2018 | Collett et al. |
| 10,420,372 | B2 | 9/2019 | Suzuki et al. |
| 10,524,508 | B2 | 1/2020 | Sur et al. |
| 2002/0005207 | A1 | 1/2002 | Wrenn et al. |
| 2002/0078951 | A1 | 6/2002 | Nichols et al. |
| 2002/0078956 | A1 | 6/2002 | Sharpe et al. |
| 2003/0007887 | A1 | 1/2003 | Roumpos et al. |
| 2003/0102304 | A1 | 6/2003 | Boyers |
| 2003/0230567 | A1 | 12/2003 | Centanni et al. |
| 2004/0149297 | A1 | 8/2004 | Sharpe |
| 2005/0025213 | A1 | 2/2005 | Parks |
| 2005/0045193 | A1 | 3/2005 | Yang |
| 2007/0267409 | A1 | 11/2007 | Gard et al. |
| 2009/0120928 | A1 | 5/2009 | Lee et al. |
| 2009/0151717 | A1 | 6/2009 | Bowen et al. |
| 2009/0293888 | A1 | 12/2009 | Williams et al. |
| 2010/0024834 | A1 | 2/2010 | Oglesby et al. |
| 2010/0181387 | A1 | 7/2010 | Zaffaroni et al. |
| 2011/0240022 | A1 | 10/2011 | Hodges et al. |
| 2011/0271971 | A1 | 11/2011 | Conner et al. |
| 2012/0145703 | A1 | 6/2012 | Matsen et al. |
| 2012/0214926 | A1 | 8/2012 | Berthold et al. |
| 2012/0234315 | A1 | 9/2012 | Li et al. |
| 2012/0305545 | A1 | 12/2012 | Brosnan et al. |
| 2013/0030125 | A1 | 1/2013 | Buryak et al. |
| 2013/0133675 | A1 | 5/2013 | Shinozaki et al. |
| 2013/0160780 | A1 | 6/2013 | Matsumoto et al. |
| 2014/0060554 | A1 | 3/2014 | Collett et al. |
| 2014/0158144 | A1 | 6/2014 | Kaljura et al. |
| 2014/0216485 | A1 | 8/2014 | Egoyants et al. |
| 2014/0301721 | A1 | 10/2014 | Ruscio |
| 2015/0040925 | A1 | 2/2015 | Saleem et al. |
| 2015/0181937 | A1 | 7/2015 | Dubief et al. |
| 2015/0201670 | A1 | 7/2015 | Crooks et al. |
| 2015/0201675 | A1 | 7/2015 | Lord |
| 2015/0237913 | A1 | 8/2015 | Suzuki et al. |
| 2015/0245669 | A1 | 9/2015 | Cadieux |
| 2015/0272219 | A1* | 10/2015 | Hatrick ..... A24F 47/004 131/328 |
| 2015/0335062 | A1 | 11/2015 | Shinkawa et al. |
| 2016/0007652 | A1 | 1/2016 | Taluskie et al. |
| 2016/0120221 | A1 | 5/2016 | Mironov et al. |
| 2016/0150825 | A1 | 6/2016 | Mironov et al. |
| 2016/0192708 | A1 | 7/2016 | DeMeritt et al. |
| 2016/0324215 | A1 | 11/2016 | Mironov et al. |
| 2016/0331031 | A1 | 11/2016 | Malgat et al. |
| 2017/0055574 | A1 | 3/2017 | Kaufman et al. |
| 2017/0055575 | A1 | 3/2017 | Wilke et al. |
| 2017/0055580 | A1 | 3/2017 | Blandino et al. |
| 2017/0055581 | A1 | 3/2017 | Wilke et al. |
| 2017/0055582 | A1 | 3/2017 | Blandino et al. |
| 2017/0055583 | A1 | 3/2017 | Blandino et al. |
| 2017/0055584 | A1 | 3/2017 | Blandino et al. |
| 2017/0055585 | A1* | 3/2017 | Fursa ..... H05B 6/105 |
| 2017/0071250 | A1 | 3/2017 | Mironov et al. |
| 2017/0095006 | A1 | 4/2017 | Egoyants et al. |
| 2017/0119046 | A1 | 5/2017 | Kaufman et al. |
| 2017/0119047 | A1 | 5/2017 | Blandino et al. |
| 2017/0119048 | A1 | 5/2017 | Kaufman et al. |
| 2017/0119049 | A1 | 5/2017 | Blandino et al. |
| 2017/0119050 | A1 | 5/2017 | Blandino et al. |
| 2017/0119051 | A1 | 5/2017 | Blandino et al. |
| 2017/0156403 | A1 | 6/2017 | Gill et al. |
| 2017/0174418 | A1 | 6/2017 | Cai |
| 2017/0199048 | A1 | 7/2017 | Igumnov et al. |
| 2017/0251718 | A1 | 9/2017 | Armoush et al. |
| 2017/0325506 | A1* | 11/2017 | Batista ..... A24F 40/465 |
| 2018/0228217 | A1 | 8/2018 | Mironov et al. |
| 2018/0235279 | A1 | 8/2018 | Wilke et al. |
| 2018/0242633 | A1 | 8/2018 | Wilke et al. |
| 2018/0242636 | A1 | 8/2018 | Blandino et al. |
| 2018/0279677 | A1 | 10/2018 | Blandino et al. |
| 2018/0317552 | A1 | 11/2018 | Kaufman et al. |
| 2018/0317553 | A1 | 11/2018 | Blandino et al. |
| 2018/0360123 | A1 | 12/2018 | Silvestrini |
| 2019/0159517 | A1 | 5/2019 | Ballesteros Gomez et al. |
| 2019/0239555 | A1 | 8/2019 | Nicholson |
| 2020/0054068 | A1 | 2/2020 | Blandino et al. |
| 2020/0054069 | A1 | 2/2020 | Blandino et al. |

FOREIGN PATENT DOCUMENTS

| | | | |
|---|---|---|---|
| CA | 2003521 | A1 | 5/1990 |
| CA | 2003522 | A1 | 5/1990 |
| CA | 2937722 | A1 | 11/2015 |

(56) References Cited

FOREIGN PATENT DOCUMENTS

| | | | | | |
|---|---|---|---|---|---|
| CA | 2974770 | A1 | | 12/2015 | |
| CA | 2982164 | A1 | | 10/2016 | |
| CN | 1126426 | A | | 7/1996 | |
| CN | 2393205 | Y | | 8/2000 | |
| CN | 2738167 | Y | | 11/2005 | |
| CN | 2924411 | Y | | 7/2007 | |
| CN | 101084801 | A | | 12/2007 | |
| CN | 201076006 | Y | | 6/2008 | |
| CN | 201088138 | Y | | 7/2008 | |
| CN | 101277623 | A | | 10/2008 | |
| CN | 101326138 | A | | 12/2008 | |
| CN | 101390659 | A | | 3/2009 | |
| CN | 201199922 | Y | | 3/2009 | |
| CN | 101951796 | A | | 1/2011 | |
| CN | 201762288 | U | | 3/2011 | |
| CN | 103202540 | A | | 7/2013 | |
| CN | 203369386 | U | | 1/2014 | |
| CN | 203435685 | U | | 2/2014 | |
| CN | 103689812 | A | | 4/2014 | |
| CN | 203735483 | U | | 7/2014 | |
| CN | 103988576 | A | | 8/2014 | |
| CN | 203748687 | U | | 8/2014 | |
| CN | 203762288 | U | | 8/2014 | |
| CN | 104013109 | A | | 9/2014 | |
| CN | 104095291 | A | | 10/2014 | |
| CN | 104256899 | A | * | 1/2015 | ..... A24F 47/008 |
| CN | 204091003 | U | | 1/2015 | |
| CN | 104365175 | A | | 2/2015 | |
| CN | 104470387 | A | | 3/2015 | |
| CN | 104480800 | A | | 4/2015 | |
| CN | 104619202 | A | | 5/2015 | |
| CN | 104664608 | A | | 6/2015 | |
| CN | 104768407 | A | | 7/2015 | |
| CN | 204519366 | U | | 8/2015 | |
| CN | 204539505 | U | | 8/2015 | |
| CN | 204599333 | U | | 9/2015 | |
| CN | 104994757 | A | | 10/2015 | |
| CN | 105188425 | A | | 12/2015 | |
| CN | 105682488 | A | | 6/2016 | |
| CN | 104095291 | B | | 1/2017 | |
| EA | 009116 | B1 | | 10/2007 | |
| EP | 0430559 | A2 | | 6/1991 | |
| EP | 0430566 | A2 | | 6/1991 | |
| EP | 0488488 | A1 | | 6/1992 | |
| EP | 0703735 | A1 | | 4/1996 | |
| EP | 0703735 | B1 | | 7/2001 | |
| EP | 1357025 | A2 | | 10/2003 | |
| EP | 1454840 | A1 | | 9/2004 | |
| EP | 1454840 | B1 | | 9/2006 | |
| EP | 1940254 | A2 | | 7/2008 | |
| EP | 2059091 | A2 | | 5/2009 | |
| EP | 1357025 | B1 | | 7/2009 | |
| EP | 2186833 | A1 | | 5/2010 | |
| EP | 2316286 | A1 | | 5/2011 | |
| EP | 2327318 | A1 | | 6/2011 | |
| EP | 2444112 | A1 | | 4/2012 | |
| EP | 2253541 | B1 | | 5/2012 | |
| EP | 2460424 | A1 | | 6/2012 | |
| EP | 2907397 | A1 | | 8/2015 | |
| EP | 3367823 | A2 | | 9/2018 | |
| EP | 3632244 | A1 | | 4/2020 | |
| GB | 347650 | A | | 4/1931 | |
| GB | 2495923 | A | | 5/2013 | |
| GB | 2504732 | A | | 2/2014 | |
| GB | 2504733 | A | | 2/2014 | |
| JP | S457120 | Y1 | | 4/1970 | |
| JP | H03113366 | A | | 5/1991 | |
| JP | H0556298 | U | | 7/1993 | |
| JP | H07502188 | A | | 3/1995 | |
| JP | H0850422 | A | | 2/1996 | |
| JP | H0851175 | A | | 2/1996 | |
| JP | H08511175 | A | | 11/1996 | |
| JP | 2002144451 | A | | 5/2002 | |
| JP | 2004121594 | A | | 4/2004 | |
| JP | 3588469 | B2 | | 11/2004 | |
| JP | 2004331191 | A | | 11/2004 | |
| JP | 2008050422 | A | | 3/2008 | |
| JP | 2008511175 | A | | 4/2008 | |
| JP | 2009087703 | A | | 4/2009 | |
| JP | 2010022754 | A | | 2/2010 | |
| JP | 2010050834 | A | | 3/2010 | |
| JP | 2010508034 | A | | 3/2010 | |
| JP | WO2010113702 | A1 | | 10/2012 | |
| JP | 2013013441 | A | | 1/2013 | |
| JP | 2015524261 | A | | 8/2015 | |
| JP | 2015531601 | A | | 11/2015 | |
| JP | 2016508744 | A | | 3/2016 | |
| JP | 2016516402 | A | | 6/2016 | |
| JP | 2016538842 | A | | 12/2016 | |
| JP | 2017515490 | A | | 6/2017 | |
| JP | 6875044 | B2 | | 5/2021 | |
| JP | 6933323 | B2 | | 9/2021 | |
| KR | 100385395 | B1 | | 8/2003 | |
| KR | 20100108565 | A | | 10/2010 | |
| KR | 20130029697 | A | | 3/2013 | |
| KR | 20150047616 | A | | 5/2015 | |
| KR | 20150132112 | A | | 11/2015 | |
| KR | 20150143877 | A | | 12/2015 | |
| KR | 20160064159 | A | | 6/2016 | |
| RU | 2132629 | C1 | | 7/1999 | |
| RU | 2135054 | C1 | | 8/1999 | |
| RU | 103281 | U1 | | 4/2011 | |
| RU | 2425608 | C2 | | 8/2011 | |
| RU | 2509516 | C2 | | 3/2014 | |
| RU | 2531890-02 | | | 10/2014 | |
| WO | WO-8404698 | A1 | | 12/1984 | |
| WO | WO-9409842 | A1 | | 5/1994 | |
| WO | WO 9527411 | | | 10/1995 | |
| WO | WO-9527412 | A1 | | 10/1995 | |
| WO | WO-9618662 | A1 | | 6/1996 | |
| WO | WO-02089532 | A1 | | 11/2002 | |
| WO | WO-02098389 | A1 | | 12/2002 | |
| WO | WO-2007051163 | A2 | | 5/2007 | |
| WO | WO-2008015441 | A1 | | 2/2008 | |
| WO | WO-2009079641 | A2 | | 6/2009 | |
| WO | WO-2010133342 | A1 | | 11/2010 | |
| WO | WO-2011130414 | A1 | | 10/2011 | |
| WO | WO-2012134117 | A2 | | 10/2012 | |
| WO | WO-2012164009 | A2 | | 12/2012 | |
| WO | WO-2013034459 | A1 | | 3/2013 | |
| WO | WO-2013098395 | A1 | | 7/2013 | |
| WO | WO-2013098409 | A1 | | 7/2013 | |
| WO | WO-2013131763 | A1 | | 9/2013 | |
| WO | WO-2013131764 | A1 | | 9/2013 | |
| WO | WO-2013144324 | A1 | | 10/2013 | |
| WO | WO-2013178766 | A1 | | 12/2013 | |
| WO | WO-2014023965 | A1 | | 2/2014 | |
| WO | WO-2014023967 | A1 | | 2/2014 | |
| WO | WO-2014048745 | A1 | | 4/2014 | |
| WO | WO-2014054035 | A1 | | 4/2014 | |
| WO | WO-2014061477 | A1 | | 4/2014 | |
| WO | WO-2014102092 | A1 | | 7/2014 | |
| WO | WO-2014104078 | A1 | | 7/2014 | |
| WO | WO-2014139611 | A1 | | 9/2014 | |
| WO | WO-2014140320 | A1 | | 9/2014 | |
| WO | WO-2015019101 | A1 | | 2/2015 | |
| WO | WO-2015062983 | A2 | | 5/2015 | |
| WO | WO-2015071682 | A1 | | 5/2015 | |
| WO | WO-2015082648 | A1 | | 6/2015 | |
| WO | WO-2015082649 | A1 | | 6/2015 | |
| WO | WO-2015082651 | A1 | | 6/2015 | |
| WO | WO-2015082652 | A1 | | 6/2015 | |
| WO | WO-2015082653 | A1 | | 6/2015 | |
| WO | WO-2015100361 | A1 | | 7/2015 | |
| WO | WO-2015101479 | A1 | | 7/2015 | |
| WO | WO-2015116934 | A1 | | 8/2015 | |
| WO | WO-2015117702 | A1 | | 8/2015 | |
| WO | WO-2015131058 | A1 | | 9/2015 | |
| WO | WO-2015155289 | A1 | | 10/2015 | |
| WO | WO-2015166245 | A2 | | 11/2015 | |
| WO | WO 2015175568 | | | 11/2015 | |
| WO | WO 2015176898 | | | 11/2015 | |
| WO | WO-2015177043 | A1 | | 11/2015 | |
| WO | WO-2015177044 | A1 | | 11/2015 | |

(56) References Cited

FOREIGN PATENT DOCUMENTS

| | | | |
|---|---|---|---|
| WO | WO-2015177045 | A1 | 11/2015 |
| WO | WO-2015177046 | A1 | 11/2015 |
| WO | WO-2015177247 | A1 | 11/2015 |
| WO | WO 2015177253 | | 11/2015 |
| WO | WO 2015177255 | | 11/2015 |
| WO | WO 2015177257 | | 11/2015 |
| WO | WO-2015177264 | A1 | 11/2015 |
| WO | WO-2015177294 | A1 | 11/2015 |
| WO | WO-2015198015 | A1 | 12/2015 |
| WO | WO-2016023965 | A1 | 2/2016 |
| WO | WO-2016075426 | A1 | 5/2016 |
| WO | WO-2016075436 | A1 | 5/2016 |
| WO | WO 2016096865 | | 6/2016 |
| WO | WO-2016162446 | A1 | 10/2016 |
| WO | WO-2016207407 | A1 | 12/2016 |
| WO | WO-2017005705 | A1 | 1/2017 |
| WO | WO-2017029269 | A1 | 2/2017 |
| WO | WO-2017036950 | A2 | 3/2017 |
| WO | WO-2017036951 | A1 | 3/2017 |
| WO | WO 2017036954 | | 3/2017 |
| WO | WO 2017036955 | | 3/2017 |
| WO | WO-2017036957 | A1 | 3/2017 |
| WO | WO-2017036958 | A2 | 3/2017 |
| WO | WO-2017036959 | A1 | 3/2017 |
| WO | WO-2017036958 | A3 | 4/2017 |
| WO | WO-2017068098 | A1 | 4/2017 |
| WO | WO-2017072146 | A1 | 5/2017 |
| WO | WO-2017072147 | A2 | 5/2017 |
| WO | WO-2017072148 | A1 | 5/2017 |
| WO | WO-2017072147 | A3 | 7/2017 |
| WO | WO-2017167932 | A1 | 10/2017 |

OTHER PUBLICATIONS

Application and File History for U.S. Appl. No. 16/311,411, filed Dec. 19, 2018, inventors Abi Aounet al.
Application and File History for U.S. Appl. No. 16/311,418, filed Dec. 19, 2018, inventors Abi Aounet al.
Application and File History for U.S. Appl. No. 15/772,399, filed Apr. 30, 2018, inventor Thomas P. Blandino.
Application and File History for U.S. Appl. No. 15/772,394, filed Apr. 30, 2018, inventors Blandino et al.
Examination Report for Australian Application No. 2016313708, dated Nov. 1, 2019, 7 pages.
Examination Report for Australian Application No. 2016313708, dated Nov. 23, 2018, 6 pages.
Examination Report dated Sep. 6, 2019 for Australian Application No. 2017289114, 7 pages.
Examination Report No. 1 for Australian Patent Application No. 2018334042 dated Dec. 16, 2020, 4 pages.
Extended European Search Report for Application No. 20202666.2, dated Feb. 19, 2021, 14 pages.
Extended European Search Report for Application No. 20205060.5, dated Mar. 2, 2021, 19 pages.
Extended European Search Report for Application No. EP20205306.2, dated Feb. 19, 2021, 12 pages.
First Office Action and Search Report dated Mar. 4, 2020 for Chinese Application No. 201680077608.1 filed Oct. 26, 2016, 18 pages.
International Preliminary Report on Patentability for Application No. PCT/EP2016/075735, dated Jan. 2, 2018, 8 pages.
International Preliminary Report on Patentability for Application No. PCT/EP2016/075737, dated May 11, 2018, 10 pages.
International Preliminary Report on Patentability for Application No. PCT/EP2016/075738, dated May 11, 2018, 9 pages.
International Preliminary Report on Patentability for Application No. PCT/EP2017/065906, dated Jan. 10, 2019, 9 pages.
International Preliminary Report on Patentability for Application No. PCT/EP2017/065908, dated Jan. 10, 2019, 9 pages.
International Preliminary Report on Patentability for Application No. PCT/EP2018/075093, dated Mar. 26, 2020, 8 pages.
International Preliminary Report on Patentability for Application No. PCT/EP2017/065909, dated Jan. 10, 2019, 7 pages.
International Search Report and Written Opinion for Application No. PCT/EP2016/070190, dated Mar. 13, 2017, 19 pages.
International Search Report and Written Opinion for Application No. PCT/EP2016/075735, dated Feb. 2, 2017, 10 pages.
International Search Report and Written Opinion for Application No. PCT/EP2016/075736, dated Feb. 14, 2017, 6 pages.
International Search Report and Written Opinion for Application No. PCT/EP2016/075737, dated Jun. 16, 2017, 14 pages.
International Search Report and Written Opinion for Application No. PCT/EP2016/075738, dated Mar. 2, 2017, 12 pages.
International Search Report and Written Opinion for Application No. PCT/EP2017/065908, dated Oct. 17, 2017, 11 pages.
International Search Report and Written Opinion for Application No. PCT/EP2017/065909, dated Oct. 24, 2017, 10 pages.
International Search Report and Written Opinion for Application No. PCT/EP2018/075093, dated Jan. 4, 2019, 11 pages.
Iorga A., et al., "Low Curie Temperature in Fe—Cr—Ni—Mn Alloys," U.P.B. Sci.Bull., Series B, vol. 73 (4), 2011, pp. 195-202.
Neomax Materials Co., Ltd., "NeoMax MS-135," retrieved from http://www.neomax-materials.co.jp/eng/pr0510.htm, as accessed on Oct. 30, 2015, 2 pages.
Notice of Reasons For Refusal Office Action dated Sep. 8, 2020 for Japanese Application No. 2018-567856, 8 pages.
Notice of Reasons For Rejection Office Action dated Mar. 17, 2020 for Japanese Application No. 2018-522061, 7 pages.
Office Action and Search Report dated Apr. 14, 2020 for Chinese Application No. 201680063711.0, 28 pages.
Office Action dated Jun. 25, 2019 for Japanese Application No. 2018-521546, 4 pages.
Office Action for Chinese Application No. 201780039879.2 dated Sep. 18, 2020, 7 pages.
Office Action dated Mar. 1, 2019 for Canadian Application No. 2996341, 4 pages.
Office Action dated Sep. 9, 2020 for Chinese Application No. 201780040874.1, 20 pages.
Office Action dated Dec. 11, 2019 for Brazilian Application No. BR1120180085138, 6 pages.
Office Action dated Sep. 15, 2020 for Japanese Application No. 2018-567854, 8 pages.
Office Action dated Feb. 16, 2021 for Japanese Application No. 2018-567856, 2 pages.
Office Action dated Aug. 19, 2020 for KR Application No. 20187037693, filed Jun. 27, 2017, 21 pages.
Office Action dated Mar. 2, 2021 for Japanese Application No. 2018-567947, 4 pages.
Office Action dated Mar. 22, 2019 for Korean Application No. 10-2018-7012422, 19 pages.
Office Action dated Mar. 22, 2019 for Korean Application No. 10-2018-7012428, 22 pages.
Office Action dated Jul. 23, 2019 for Japanese Application No. 2018-521928, 14 pages.
Office Action dated Jul. 23, 2019 for Japanese Application No. 2018-522061, 9 pages.
Office Action dated Feb. 25, 2020 for Japanese Application No. 2018-567854, 7 pages.
Office Action dated Feb. 25, 2020 for Japanese Application No. 2018-567947, 6 pages.
Office Action dated Feb. 25, 2020 for Japanese Application No. 2018-567856, 6 pages.
Office Action dated Jun. 25, 2019 for Japanese Application No. 2018-519932, 5 pages.
Office Action dated Sep. 26, 2019 for Korean Application No. 10-2018-7012353, 15 pages.
Office Action dated Dec. 27, 2019 for Chinese Application No. 201680049091, 25 pages.
Office Action dated Mar. 28, 2019 for Canadian Application No. 3003520, , 3 pages.
Office Action dated Mar. 29, 2019 for Korean Application No. 10-2018-7012366, 6 pages.
Office Action dated Oct. 29, 2018 for Russian Application No. 2018115542, 9 pages.

(56) References Cited

OTHER PUBLICATIONS

Office Action dated Feb. 4, 2020 for Japanese Application No. 2018-507621, 29 pages.
Office Action dated Feb. 7, 2019 for Korean Application No. 10-2018- 7006076, 10 pages.
Office Action dated May 7, 2019 for Japanese Application No. 2018-507621, 8 pages.
Office Action dated Dec. 9, 2019 for Canadian Application No. 3003521, 6 pages.
Todaka T., et al., "Low Curie Temperature Material for Induction Heating Self-Temperature Controlling System," Journal of Magnetism and Magnetic Materials, vol. 320 (20), Oct. 2008, pp. e702-e707.
Application and File History for U.S. Appl. No. 15/772,391, filed Nov. 8, 2018, inventors Kaufman et al.
Application and File History for U.S. Appl. No. 14/840,897, filed Aug. 31, 2015, inventors Kaufman et al.
Application and File History for U.S. Appl. No. 16/946,043, filed Jun. 3, 2020, inventors Blandino et al.
Application and File History for U.S. Appl. No. 14/927,529, filed Oct. 30, 2015, inventors Kaufman et al.
Application and File History for U.S. Appl. No. 14/927,532, filed Oct. 30, 2015, inventors Blandino et al.
Application and File History for U.S. Appl. No. 14/927,537, filed Oct. 30, 2015, inventors Kaufman et al.
Application and File History for U.S. Appl. No. 14/927,539, filed Oct. 30, 2015, inventors Blandino et al.
Application and File History for U.S. Appl. No. 14/927,551, filed Oct. 30, 2015, inventors Blandino et al.
Application and File History for U.S. Appl. No. 14/927,556, filed Oct. 30, 2015, inventors Blandino et al.
Application and File History for U.S. Appl. No. 15/754,834, filed Feb. 23, 2018, inventor Thomas P. Blandino.
Application and File History for U.S. Appl. No. 15/772,396, filed Apr. 30, 2018, inventor Thomas P. Blandino.
Application and File History for U.S. Appl. No. 15/733,194, filed Jun. 8, 2020, inventors Abi Aoun et al.
Application and File History for U.S. Appl. No. 16/311,405, filed Dec. 19, 2018, inventors Abi Aoun et al.
Application and File History for U.S. Appl. No. 16/647,325, filed Mar. 13, 2020, inventors Thorsen et al.
Communication pursuant to Article 94(3) EPC for Application No. 16798648.8, dated Nov. 19, 2020, 9 pages.
English Translation of Chinese Office Action, Application No. 2016800490915, dated Aug. 14, 2020, 8 pages.
European Search Report for European Application No. 20205063.9, dated Feb. 18, 2021. 13 pages.
Extended European Search Report for Application No. 20205060.5, dated Aug. 6, 2021, 20 pages.
Extended European Search Report for Application No. 20205065.4, dated Mar. 10, 2021, 14 pages.
International Preliminary Report on Patentability for Application No. PCT/EP2016/070190, dated Mar. 15, 2018, 12 pages.
International Preliminary Report on Patentability for Application No. PCT/EP2016/075736, dated May 11, 2018, 6 pages.
International Search Report and Written Opinion for Application No. PCT/EP2018/058195, dated Nov. 12, 2018, 20 pages.
International Search Report for Application No. PCT/EP2018/083795, dated Mar. 15, 2019, 3 pages.
Notice of Opposition dated Jun. 3, 2020 for European Application No. 16766494.5, 37 pages.
Office Action dated Jun. 1, 2021, for Russian Application No. 2020135859, 12 pages.
Office Action for Canadian Application No. 3,056,677, dated Nov. 24, 2020, 6 pages.
Office Action for Chinese Application No. 201680072882.X, dated Jan. 14, 2021, 12 pages.
Office Action for Japanese Application No. 2020-093539, dated Apr. 6, 2021, 6 pages.
Office Action for Japanese Application No. 2020-175420, dated Oct. 12, 2021, 9 pages.
Office Action for Japanese Application No. 2020-182740, dated Oct. 12, 2021, 10 pages.
Office Action for Japanese Application No. 2020-182750, dated Oct. 12, 2021, 8 pages.
Office Action for Korean Application No. 10-2018-7037677, dated May 12, 2021, 4 pages.
Office Action for Korean Application No. 10-2018-7037677, dated Mar. 29, 2021, 6 pages.
Office Action for Korean Application No. 10-2021-7018056, dated Oct. 27, 2021, 21 pages.
Office Action for Malaysian Application No. PI2018002742, dated Apr. 21, 2021, 4 pages.
Office Action for Russian Application No. 2020135808, dated Apr. 23, 2021, 12 pages.
Office Action for Russian Application No. 2020135851, dated May 24, 2021, 13 pages.
Office Action dated May 12, 2021 for Chinese Application No. 201780040874.1, 15 pages.
Office Action dated May 12, 2021 for Korean Application No. 10-2018-7037693, 7 pages.
Office Action dated Apr. 29, 2021, for Malaysian Application No. PI2018701525, 3 pages.
Communication pursuant to Article 94(3) EPC for Application No. 16798649.6, dated Jul. 5, 2021, 7 pages.
Decision to Grant a Patent dated Mar. 15, 2022 for Japanese Application No. 2020-183062, 5 pages.
European Search Report for Application No. 21213373.0, dated Apr. 26, 2022, 7 pages.
Extended European Search Report for Application No. 20204770.0, dated Jun. 30, 2021, 14 pages.
Notice of Reasons for Refusal For Japanese Application No. 2020-528003, dated Jul. 20, 2021, 3 pages.
Notification of Reason for Refusal dated Jan. 3, 2022 for Korean Application No. 10-2020-7018918, 12 pages.
Office Action and Search Report for Chinese Application No. 201880059756, dated Jan. 14, 2022, 11 pages.
Office Action and Search Report for Russian Application No. 2020134245, dated Jan. 19, 2022, 27 pages.
Office Action and Search Report dated Jan. 18, 2022 for Russian Application No. 2020134241, 22 pages.
Office Action dated Jun. 17, 2021 for Ukraine Application No. 201804590, 3 pages.
Office Action for Brazilian Application No. 112018077348-4, dated Sep. 27, 2021, 4 pages.
Office Action For Canadian Application No. 3,003,519, dated Jul. 30, 2021, 4 pages.
Office Action For Chinese Application No. 201680072882. X, dated Sep. 1, 2021, 17 pages.
Office Action For Chinese Application No. 201780040300.4, dated Nov. 15, 2021, 14 pages.
Office Action For Japanese Application No. 2020-183062, dated Nov. 30, 2021, 6 pages.
Office Action For Japanese Application No. 2020-191836, dated Oct. 26, 2021, 8 pages.
Office Action For Japanese Application No. 2020-191838, dated Oct. 26, 2021, 8 pages.
Office Action for Japanese Application No. 2022-010005, dated Mar. 15, 2022, 3 pages.
Office Action For Korean Application No. 10-2021-7023346, dated Dec. 14, 2021, 40 pages.
Office Action for Great Britain Application No. 177440628.7, dated Sep. 5, 2022, 9 pages.

* cited by examiner

APPARATUS FOR HEATING SMOKABLE MATERIAL

PRIORITY CLAIM

The present application is a National Phase entry of PCT Application No. PCT/EP2017/065906, filed Jun. 27, 2017, which claims priority from Provisional Application No. 62/356,343, filed Jun. 29, 2016, each of which is hereby fully incorporated herein by reference.

TECHNICAL FIELD

The present disclosure relates to an apparatus for heating smokable material to volatilize at least one component of the smokable material, to systems comprising such an apparatus and articles comprising smokable material, and to methods of heating smokable material to volatilize at least one component of the smokable material.

BACKGROUND

Smoking articles such as cigarettes, cigars and the like burn tobacco during use to create tobacco smoke. Attempts have been made to provide alternatives to these articles by creating products that release compounds without combusting. Examples of such products are so-called "heat not burn" products or tobacco heating devices or products, which release compounds by heating, but not burning, material. The material may be, for example, tobacco or other non-tobacco products, which may or may not contain nicotine.

SUMMARY

A first aspect of the present disclosure provides an apparatus for heating smokable material to volatilize at least one component of the smokable material, the apparatus comprising: a heating zone for receiving at least a portion of an article comprising smokable material; an outlet for permitting volatilized components of the smokable material to pass from the heating zone towards an exterior of the apparatus when the article is heated in the heating zone in use; a heating element that is heatable by penetration with a varying magnetic field to heat the heating zone, wherein a first section of the heating element is located between a second section of the heating element and the outlet, and wherein the second section of the heating element is heatable in use by thermal conduction from the first section of the heating element; and a magnetic field generator for generating a varying magnetic field that penetrates the first section of the heating element and avoids the second section of the heating element.

In an exemplary embodiment, the apparatus is free from any magnetic field generator for generating a varying magnetic field that penetrates the second section of the heating element.

In an exemplary embodiment, the second section of the heating element is heatable in use exclusively by thermal conduction.

In an exemplary embodiment, the heating element projects into the heating zone.

In an exemplary embodiment, the heating element extends at least partially around the heating zone.

In an exemplary embodiment, the magnetic field generator comprises a helical coil that encircles only the first section of the heating element.

In an exemplary embodiment, the magnetic field generator is fixed relative to the heating element.

In an exemplary embodiment, the first section of the heating element is smaller or shorter than the second section of the heating element.

In an exemplary embodiment, the heating element comprises heating material that comprises one or more materials selected from the group consisting of: an electrically-conductive material, a magnetic material, and a magnetic electrically-conductive material.

In an exemplary embodiment, the heating element comprises heating material that comprises a metal or a metal alloy.

In an exemplary embodiment, the heating element comprises heating material that comprises one or more materials selected from the group consisting of: aluminum, gold, iron, nickel, cobalt, conductive carbon, graphite, plain-carbon steel, stainless steel, ferritic stainless steel, copper, and bronze.

In an exemplary embodiment, the first section of the heating element is made of a first material and the second section of the heating element is made of a second material that is different from the first material.

In an exemplary embodiment, the apparatus is for heating non-liquid smokable material to volatilize at least one component of the smokable material.

In an exemplary embodiment, the apparatus is for heating smokable material to volatilize at least one component of the smokable material without combusting the smokable material.

A second aspect of the present disclosure provides an apparatus for heating smokable material to volatilize at least one component of the smokable material, the apparatus comprising: a heating zone for receiving at least a portion of an article comprising smokable material; an outlet for permitting volatilized components of the smokable material to pass from the heating zone towards an exterior of the apparatus when the article is heated in the heating zone in use, wherein a first portion of the heating zone is located between a second portion of the heating zone and the outlet; and a magnetic field generator for generating a varying magnetic field that penetrates the first portion of the heating zone and avoids the second portion of the heating zone.

In an exemplary embodiment, the apparatus is free from any magnetic field generator for generating a varying magnetic field that penetrates the second portion of the heating zone.

In an exemplary embodiment, the magnetic field generator comprises a helical coil that encircles only the first portion of the heating zone.

In an exemplary embodiment, the first portion of the heating zone is smaller or shorter than the second portion of the heating zone.

In an exemplary embodiment, the apparatus is arranged so that the article is insertable into the second portion of the heating zone via the first portion of the heating zone.

In an exemplary embodiment, the apparatus is for heating non-liquid smokable material to volatilize at least one component of the smokable material.

In an exemplary embodiment, the apparatus is for heating smokable material to volatilize at least one component of the smokable material without combusting the smokable material.

A third aspect of the present disclosure provides a system for heating smokable material to volatilize at least one component of the smokable material, the system comprising: an article comprising smokable material and a heating element that is heatable by penetration with a varying magnetic field to heat the smokable material; and an apparatus, comprising: a heating zone for receiving at least a portion of the article; an outlet for permitting volatilized components of the smokable material to pass from the heating zone when the article is heated in the heating zone in use; and a magnetic field generator for generating a varying magnetic field that penetrates a first section of the heating element between a second section of the heating element and the outlet, and avoids the second section of the heating element, when the article is located in the heating zone in use.

In an exemplary embodiment, the apparatus of the system of the third aspect is the apparatus of the second aspect. The apparatus of the system of the third aspect may have any one or more of the features discussed above as being present in respective exemplary embodiments of the apparatus of the second aspect.

A fourth aspect of the present disclosure provides a method of heating smokable material to volatilize at least one component of the smokable material, the method comprising: providing a heating element formed that is heatable by penetration with a varying magnetic field; providing smokable material in thermal contact with the heating element; penetrating a first section of the heating element with a varying magnetic field that avoids a second section of the heating element, thereby to heat the first section of the heating element and a first part of the smokable material; and heating the second section of the heating element by thermal conduction from the first section of the heating element, thereby to heat a second part of the smokable material.

BRIEF DESCRIPTION OF THE DRAWINGS

Embodiments of the disclosure will now be described, by way of example only, with reference to the accompanying drawings, in which.

DETAILED DESCRIPTION

Figure 1:
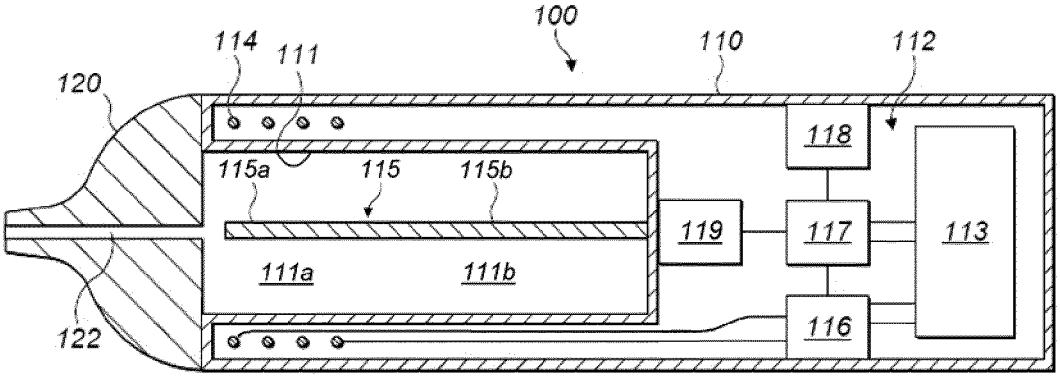
FIG. 1 shows a schematic cross-sectional view of an example of an apparatus for heating smokable material to volatilize at least one component of the smokable material.

As used herein, the term "smokable material" includes materials that provide volatilized components upon heating, typically in the form of vapor or an aerosol. "Smokable material" may be a non-tobacco-containing material or a tobacco-containing material. "Smokable material" may, for example, include one or more of tobacco per se, tobacco derivatives, expanded tobacco, reconstituted tobacco, tobacco extract, homogenized tobacco or tobacco substitutes. The smokable material can be in the form of ground tobacco, cut rag tobacco, extruded tobacco, reconstituted tobacco, reconstituted smokable material, liquid, gel, gelled sheet, powder, or agglomerates, or the like. "Smokable material" also may include other, non-tobacco, products, which, depending on the product, may or may not contain nicotine. "Smokable material" may comprise one or more humectants, such as glycerol or propylene glycol.

As used herein, the term "heating material" or "heater material" refers to material that is heatable by penetration with a varying magnetic field.

Induction heating is a process in which an electrically-conductive object is heated by penetrating the object with a varying magnetic field. The process is described by Faraday's law of induction and Ohm's law. An induction heater may comprise an electromagnet and a device for passing a varying electrical current, such as an alternating current, through the electromagnet. When the electromagnet and the object to be heated are suitably relatively positioned so that the resultant varying magnetic field produced by the electromagnet penetrates the object, one or more eddy currents are generated inside the object. The object has a resistance to the flow of electrical currents. Therefore, when such eddy currents are generated in the object, their flow against the electrical resistance of the object causes the object to be heated. This process is called Joule, ohmic, or resistive heating. An object that is capable of being inductively heated is known as a susceptor.

It has been found that, when the susceptor is in the form of a closed circuit, magnetic coupling between the susceptor and the electromagnet in use is enhanced, which results in greater or improved Joule heating.

Magnetic hysteresis heating is a process in which an object made of a magnetic material is heated by penetrating the object with a varying magnetic field. A magnetic material can be considered to comprise many atomic-scale magnets, or magnetic dipoles. When a magnetic field penetrates such material, the magnetic dipoles align with the magnetic field. Therefore, when a varying magnetic field, such as an alternating magnetic field, for example as produced by an electromagnet, penetrates the magnetic material, the orientation of the magnetic dipoles changes with the varying applied magnetic field. Such magnetic dipole reorientation causes heat to be generated in the magnetic material.

When an object is both electrically-conductive and magnetic, penetrating the object with a varying magnetic field can cause both Joule heating and magnetic hysteresis heating in the object. Moreover, the use of magnetic material can strengthen the magnetic field, which can intensify the Joule heating.

In each of the above processes, as heat is generated inside the object itself, rather than by an external heat source by heat conduction, a rapid temperature rise in the object and more uniform heat distribution can be achieved, particularly through selection of suitable object material and geometry, and suitable varying magnetic field magnitude and orientation relative to the object. Moreover, as induction heating and magnetic hysteresis heating do not require a physical connection to be provided between the source of the varying magnetic field and the object, design freedom and control over the heating profile may be greater, and cost may be lower.

Referring to FIG. 1 there is shown a schematic cross-sectional view of an example of an apparatus according to an embodiment of the disclosure. The apparatus 100 is for heating smokable material to volatilize at least one component of the smokable material.

The apparatus 100 comprises a heating zone 111 for receiving at least a portion of an article comprising smokable material that is to be heated. The apparatus 100 has an outlet 122 for permitting volatilized components of the smokable material to pass from the heating zone 111 towards an exterior of the apparatus 100 when the article is heated in the heating zone 111 in use. The apparatus 100 also comprises a heating element 115 of heating material that is heatable by penetration with a varying magnetic field to heat the heating zone 111, and a magnetic field generator 112 for generating the varying magnetic field in use.

More specifically, the apparatus 100 of this embodiment comprises a body 110 and a mouthpiece 120. The mouthpiece 120 may be made of any suitable material, such as a plastics material, cardboard, cellulose acetate, paper, metal, glass, ceramic, or rubber. The mouthpiece 120 defines a channel 122 therethrough, which acts as the outlet 122. The mouthpiece 120 is locatable relative to the body 110 so as to cover an opening into the heating zone 111. When the mouthpiece 120 is so located relative to the body 110, the channel 122 of the mouthpiece 120 is in fluid communication with the heating zone 111. In use, the channel 122 acts as a passageway for permitting volatilized material to pass from an article inserted in the heating zone 111 to an exterior of the apparatus 100. In this embodiment, the mouthpiece 120 of the apparatus 100 is releasably engageable with the body 110 so as to connect the mouthpiece 120 to the body 110. In other embodiments, the mouthpiece 120 and the body 110 may be permanently connected, such as through a hinge or flexible member. In some embodiments, such as embodiments in which the article itself comprises a mouthpiece, the mouthpiece 120 of the apparatus 100 may be omitted. In such embodiments, an open end of the heating zone 111 (at the left-hand side of FIG. 1 as drawn) may act as the outlet.

The apparatus 100 may define an air inlet that fluidly connects the heating zone 111 with the exterior of the apparatus 100. Such an air inlet may be defined by the body 110 of the apparatus 100 and/or by the mouthpiece 120 of the apparatus 100. A user may be able to inhale the volatilized component(s) of the smokable material by drawing the volatilized component(s) through the channel 122 of the mouthpiece 120. As the volatilized component(s) are removed from the article, air may be drawn into the heating zone 111 via the air inlet of the apparatus 100.

In this embodiment, the body 110 comprises the heating zone 111. In this embodiment, the heating zone 111 comprises a recess 111 for receiving at least a portion of the article. In other embodiments, the heating zone 111 may be other than a recess, such as a shelf, a surface, or a projection, and may require mechanical mating with the article in order to co-operate with, or receive, the article. In this embodiment, the heating zone 111 is elongate, and is sized and shaped to accommodate the whole article. In other embodiments, the heating zone 111 may be dimensioned to receive only a portion of the article.

The heating zone 111 can be considered to comprise a first portion 111*a* and a second portion 111*b*, which are relatively arranged so that the first portion 111*a* of the heating zone 111 is located between the second portion 111*b* of the heating zone 111 and the outlet 122. The heating zone 111, and the apparatus 100 as a whole, is arranged so that the article is insertable into the second portion 111*b* of the heating zone 111 via the first portion 111*a* of the heating zone 111, when the mouthpiece 120 is disengaged from the body 110 of the apparatus 100.

In this embodiment, the magnetic field generator 112 comprises an electrical power source 113, a coil 114, a device 116 for passing a varying electrical current, such as an alternating current, through the coil 114, a controller 117, and a user interface 118 for user-operation of the controller 117.

The electrical power source 113 of this embodiment is a rechargeable battery. In other embodiments, the electrical power source 113 may be other than a rechargeable battery, such as a non-rechargeable battery, a capacitor, a battery-capacitor hybrid, or a connection to a mains electricity supply.

The coil 114 may take any suitable form. In this embodiment, the coil 114 is a helical coil of electrically-conductive material, such as copper. In some embodiments, the magnetic field generator 112 may comprise a magnetically permeable core around which the coil 114 is wound. Such a magnetically permeable core concentrates the magnetic flux produced by the coil 114 in use and makes a more powerful magnetic field. The magnetically permeable core may be made of iron, for example. In some embodiments, the magnetically permeable core may extend only partially along the length of the coil 114, so as to concentrate the magnetic flux only in certain regions. In some embodiments, the coil may be a flat coil. That is, the coil may be a two-dimensional spiral.

It will be understood from consideration of FIG. 1 that in this embodiment the heating element 115 projects into the heating zone 111. The heating element 115 has a length from a first end at which the heating element 115 is mounted to the rest of the body 110 to a free second end. The free end is arranged relative to the heating zone 111 so as to enter the article as the article is inserted into the heating zone 111. In some embodiments, the free end of the heating element 115 may be tapered, for example, to facilitate such entry into the article. In some embodiments, the heating element 115 takes the form of a spike or a pin or a blade.

The heating element 115 has a rectangular cross-section perpendicular to its length. The depth or thickness of the heating element 115 is relatively small as compared to the other dimensions of the heating element 115. Therefore, a greater proportion of the heating element 115 may be heatable by a given varying magnetic field, as compared to a heating element 115 having a depth or thickness that is relatively large as compared to the other dimensions of the heating element 115. Thus, a more efficient use of material is achieved. In turn, costs are reduced. However, in other embodiments, the heating element 115 may have a cross-section that is a shape other than rectangular, such as circular, elliptical, annular, star-shaped, polygonal, square, triangular, X-shaped, or T-Shaped. In this embodiment, the cross-section of the heating element 115 is constant along the length of the heating element 115. Moreover, in this embodiment, the heating element 115 is planar, or substantially planar. The heating element 115 of this embodiment can be considered a flat strip. However, in other embodiments, this may not be the case.

In this embodiment, the coil 114 encircles only a first section 115*a* of the heating element 115, which is located between a second section 115*b* of the heating element 115 and the outlet 122. That is, the coil 114 does not encircle the second section 115*b* of the heating element 115. The magnetic field generator 112 is for generating a varying magnetic field that penetrates the first section 115*a* of the heating element 115 and avoids the second section 115*b* of the heating element 115. That is, the varying magnetic field does not penetrate the second section 115*b* of the heating element 115. Indeed, the apparatus 100 of this embodiment is free from any magnetic field generator for generating a varying magnetic field that penetrates the second section 115*b* of the heating element 115. The second section 115*b* of the heating element 115 is heatable in use exclusively by thermal conduction from the first section 115*a* of the heating element 115.

Accordingly, when an article comprising smokable material is located in the heating zone 111 use, a portion of the article closest to the outlet 122 is heated first by heat emanating from the first section 115*a* of the heating element 115. This initiates volatilization of at least one component of the smokable material of that portion of the article and formation of an aerosol therein. Over time, the temperature of the second section 115*b* of the heating element 115 increases due to thermal conduction from the first section 115*a* of the heating element 115. This causes another portion of the article further from the outlet 122 to be heated by heat emanating from the second section 115*b* of the heating element 115. This initiates volatilization of at least one component of the smokable material of the other portion of the article and formation of an aerosol therein. Accordingly, there is provided progressive heating of the article, and thus the smokable material of the article, over time. This helps to enable an aerosol to be formed and released relatively rapidly from an end of the article relatively close to the outlet 122, for inhalation by a user, yet provides time-dependent release of aerosol, so that aerosol continues to be formed and released even after the smokable material of the first portion of the article has ceased generating aerosol. Such cessation of aerosol generation may occur as a result of the smokable material of the first portion of the article becoming exhausted of volatilizable components of the smokable material.

When the article is located in the heating zone 111, the heating element 115 is in thermal contact with the smokable material of the article. In some embodiments, when the article is located in the heating zone 111, the heating element 115 is in surface contact with the smokable material of the article. Thus, heat may be conducted directly from the heating material to the smokable material. In other embodiments, the heating material may be kept out of surface contact with the smokable material. For example, in some embodiments, the article and/or the heating element 115 may comprise a thermally-conductive barrier that is free from heating material and that spaces the heating material from the smokable material of the article in use. In some embodiments, the thermally-conductive barrier may be a coating on the heating material. The provision of such a barrier may be advantageous to help to dissipate heat to alleviate hot spots in the heating material, or to aid cleaning of the heating element 115.

As noted above, the heating zone 111 has a first portion 111*a* and a second portion 111*b*. The first portion 111*a* of the heating zone 111 is that which the varying magnetic field generated by the magnetic field generator 112 penetrates in use. On the other hand, the second portion 111*b* of the heating zone 111 is not penetrated by the varying magnetic field in use. The apparatus 100 is free from any magnetic field generator for generating a varying magnetic field that penetrates the second portion 111*b* of the heating zone 111. In some cases, the article to be used with the apparatus 100 may comprise a heating element of heating material that is heatable by penetration with a varying magnetic field. The heating element may be arranged in the article so that, when the article is located in the heating zone 111, a first portion of the heating element of the article is located in the first portion 111*a* of the heating zone 111 and a second portion of the heating element of the article is located in the second portion 111*b* of the heating zone 111. Accordingly, a similar progressive heating effect to that discussed above could be provided, whereby in use the first portion of the heating element of the article is heated inductively so as to heat a first part of the smokable material in the article, and the second portion of the heating element of the article is heated by thermal conduction from the first portion of the heating element of the article to heat a second part of the smokable material.

In this embodiment, the coil 114 extends along a longitudinal axis that is substantially aligned with a longitudinal axis of the heating zone 111. The aligned axes are coincident. In a variation to this embodiment, the aligned axes may be parallel to each other. However, in other embodiments, the axes may be oblique to each other. Moreover, the coil 114 extends along a longitudinal axis that is substantially coincident with a longitudinal axis of the heating element 115. In other embodiments, the longitudinal axes of the coil 114 and the heating element 115 may be aligned with each other by being parallel to each other, or may be oblique to each other. In this embodiment, the coil 114 and the rest of the magnetic field generator 112 is in a fixed position relative to the heating element 115 and the heating zone 111.

In this embodiment, the device 116 for passing a varying current through the coil 114 is electrically connected between the electrical power source 113 and the coil 114. In this embodiment, the controller 117 also is electrically connected to the electrical power source 113, and is communicatively connected to the device 116 to control the device 116. More specifically, in this embodiment, the controller 117 is for controlling the device 116, so as to control the supply of electrical power from the electrical power source 113 to the coil 114. In this embodiment, the controller 117 comprises an integrated circuit (IC), such as an IC on a printed circuit board (PCB). In other embodiments, the controller 117 may take a different form. In some embodiments, the apparatus may have a single electrical or electronic component comprising the device 116 and the controller 117. The controller 117 is operated in this embodiment by user-operation of the user interface 118. In this embodiment, the user interface 118 is located at the exterior of the body 110. The user interface 118 may comprise a push-button, a toggle switch, a dial, a touchscreen, or the like. In other embodiments, the user interface 118 may be remote and connected to the rest of the apparatus wirelessly, such as via Bluetooth.

In this embodiment, operation of the user interface 118 by a user causes the controller 117 to cause the device 116 to cause an alternating electrical current to pass through the coil 114, so as to cause the coil 114 to generate an alternating magnetic field. The coil 114 and the heating element 115 of the apparatus 100 are suitably relatively positioned so that the varying magnetic field produced by the coil 114 penetrates the heating material of the heating element 115. When the heating material of the heating element 115 is an electrically-conductive material, this may cause the generation of one or more eddy currents in the heating material. The flow of eddy currents in the heating material against the electrical resistance of the heating material causes the heating material to be heated by Joule heating. In this embodiment, the heating material is made of a magnetic material, and so the orientation of magnetic dipoles in the heating material changes with the changing applied magnetic field, which causes heat to be generated in the heating material.

In this embodiment, an impedance of the coil 114 of the magnetic field generator 112 is equal, or substantially equal, to an impedance of the heating element 115. If the impedance of the heating element 115 were instead lower than the impedance of the coil 114, then the voltage generated across the heating element 115 in use may be lower than the voltage that may be generated across the heating element 115 when the impedances are matched. Alternatively, if the impedance of the heating element 115 were instead higher than the impedance of the coil 114, then the electrical current generated in the heating element 115 in use may be lower than the current that may be generated in the heating element 115 when the impedances are matched. Matching the impedances may help to balance the voltage and current to maximize the heating power generated at the heating element 115 in use. In some embodiments, the impedance of the device 116 may be equal, or substantially equal, to a combined impedance of the coil 114 and the heating element 115.

The apparatus 100 of this embodiment comprises a temperature sensor 119 for sensing a temperature of the heating zone 111. The temperature sensor 119 is communicatively connected to the controller 117, so that the controller 117 is able to monitor the temperature of the heating zone 111. On the basis of one or more signals received from the temperature sensor 119, the controller 117 may cause the device 116 to adjust a characteristic of the varying or alternating electrical current passed through the coil 114 as necessary, in order to ensure that the temperature of the heating zone 111 remains within a predetermined temperature range. The characteristic may be, for example, amplitude or frequency or duty cycle. Within the predetermined temperature range, in use the smokable material within an article located in the heating zone 111 is heated sufficiently to volatilize at least one component of the smokable material without combusting the smokable material. Accordingly, the controller 117, and the apparatus 100 as a whole, is arranged to heat the smokable material to volatilize the at least one component of the smokable material without combusting the smokable material. In some embodiments, the temperature range is about 50° C. to about 300° C., such as between about 50° C. and about 250° C., between about 50° C. and about 150° C., between about 50° C. and about 120° C., between about 50° C. and about 100° C., between about 50° C. and about 80° C., or between about 60° C. and about 70° C. In some embodiments, the temperature range is between about 170° C. and about 220° C. In other embodiments, the temperature range may be other than this range. In some embodiments, the upper limit of the temperature range could be greater than 300° C. In some embodiments, the temperature sensor 119 may be omitted. In some embodiments, the heating material may have a Curie point temperature selected on the basis of the maximum temperature to which it is desired to heat the heating material, so that further heating above that temperature by induction heating the heating material is hindered or prevented.

Figure 2:
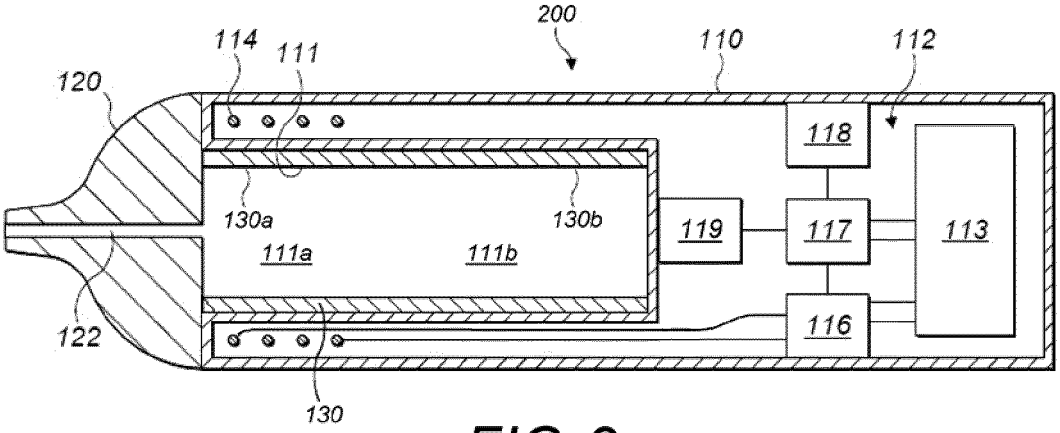
FIG. 2 shows a schematic cross-sectional view of an example of another apparatus for heating smokable material to volatilize at least one component of the smokable material.

Referring to FIG. 2 there is shown a schematic cross-sectional view of an example of another apparatus according to an embodiment of the disclosure. The apparatus 200 of FIG. 2 is identical to the apparatus 100 of FIG. 1 except for the form of the heating element of the apparatus. Therefore, in the interest of conciseness, features common to the two embodiments will not be described again in detail. Any of the herein-described possible variations to the apparatus 100 of FIG. 1 may be made to the apparatus 200 of FIG. 2 to form separate respective embodiments.

As noted above, in the apparatus 100 of FIG. 1, the heating element 115 projects into the heating zone 111. In contrast, in the apparatus 200 of FIG. 2, the heating element 130 of heating material extends around the heating zone 111. Therefore, whereas in the embodiment of FIG. 1 the heating zone 111 and any article therein in use is heated from the middle outwards, in the embodiment of FIG. 2 the heating zone 111 and any article therein in use is heated from the outside inwards.

The heating element 130 is a tubular heating element 130 that encircles the heating zone 111. However, in other embodiments, the heating element 130 may not be fully tubular. For example, in some embodiments, the heating element 130 may be tubular save for an axially-extending gap or slit formed in the heating element 130. The heating element 130 has a substantially circular cross-section. However, in other embodiments, the heating element may have a cross-section other than circular, such as square, rectangular, polygonal or elliptical. The heating element 130 extends along a longitudinal axis that is substantially aligned with a longitudinal axis of the heating zone 111. In this embodiment, the aligned axes are coincident. In a variation to this embodiment, the aligned axes may be parallel to each other. However, in other embodiments, the axes may be oblique to each other.

In this embodiment, the heating zone 111 is defined in part by the heating element 130. That is, the heating element 130 partially delineates or delimits the heating zone 111. When an article comprising smokable material is located in the heating zone 111, the heating element 130 is in thermal contact with the article. In some embodiments, when an article comprising smokable material is located in the heating zone 111, the heating element 130 is in surface contact with the article. Thus, heat may be conducted directly from the heating material to the article. In other embodiments, the heating material may be kept out of direct surface contact with the article. Examples of how this may be achieved, and benefits that may be attained by doing so, correspond to those discussed above.

Similarly to the heating element 115 of the embodiment of FIG. 1, the heating element 130 of the embodiment of FIG. 2 has a first section 130*a* and a second section 130*b*. The first section 130*a* of the heating element 130 is located between the second section 130*b* of the heating element 130 and the outlet 122. The coil 114 encircles only the first section 130*a* of the heating element 130. That is, the coil 114 does not encircle the second section 130*b* of the heating element 130. The magnetic field generator 112 is for generating a varying magnetic field that penetrates the first section 130*a* of the heating element 130 and avoids the second section 130*b* of the heating element 130. That is, the varying magnetic field does not penetrate the second section 130*b* of the heating element 130. As for the embodiment of FIG. 1, the apparatus 200 of this embodiment is free from any magnetic field generator for generating a varying magnetic field that penetrates the second section 130*b* of the heating element 130. The second section 130*b* of the heating element 130 is heatable in use exclusively by thermal conduction from the first section 130*a* of the heating element 130. This helps provide progressive heating of the article, and thus the smokable material of the article, over time, in a similar manner to that discussed above.

In a variation to this embodiment, the apparatus may comprise both the heating element 130 that extends at least partially around the heating zone 111, and another heating element that protrudes into the heating zone 111, similar to the heating element 115 of the embodiment of FIG. 1. Such an embodiment may help deliver heating of the heating zone 111 and any article therein in use from both the middle and the outside.

In each of the above-described embodiments, the first section 115*a*, 130*a* of the heating element 115, 130 is smaller or shorter than the second section 115*b*, 130*b* of the heating element 115, 130. In other embodiments, this may not be the case. For example, in some embodiments the first and second sections 115*a*, 115*b*, 130*a*, 130*b* of the heating element 115, 130 may be substantially equally sized. The skilled person would be able to determine appropriate relative sizes of the first and second sections 115*a*, 115*b*, 130*a*, 130*b* of the heating element 115, 130 that provide for a desired level of progressive heating of the article and the smokable material of the article.

Figure 3:
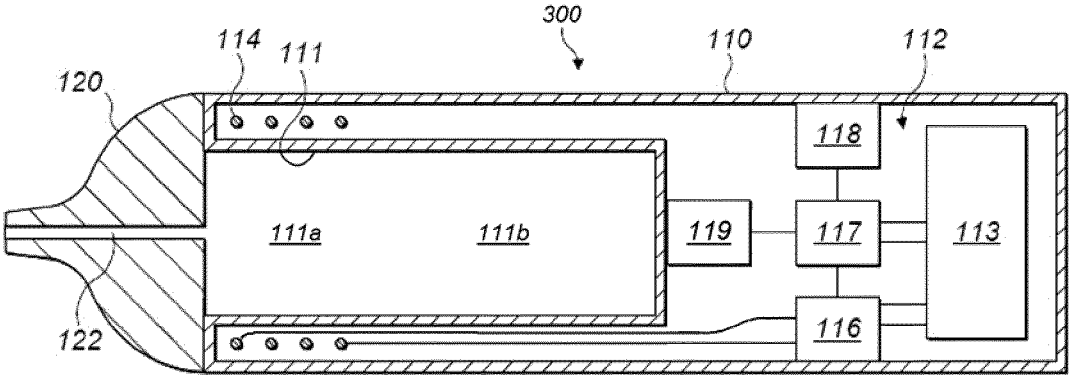
FIG. 3 shows a schematic cross-sectional view of an example of another apparatus for heating smokable material to volatilize at least one component of the smokable material.

Referring to FIG. 3 there is shown a schematic cross-sectional view of an example of another apparatus according to an embodiment of the disclosure. The apparatus 300 of FIG. 3 is identical to the apparatus 100 of FIG. 1 except that the apparatus 300 of FIG. 3 does not have a heating element that is penetrated by the varying magnetic field generated by the magnetic field generator 112. Therefore, in the interest of conciseness, features common to the two embodiments will not be described again in detail. Any of the herein-described possible variations to the apparatus 100 of FIG. 1 may be made to the apparatus 300 of FIG. 3 to form separate respective embodiments.

As discussed above with reference to FIG. 1, the heating zone 111 comprises a first portion 111*a* and a second portion 111*b*, which are relatively arranged so that the first portion 111*a* of the heating zone 111 is located between the second portion 111*b* of the heating zone 111 and the outlet 122. The heating zone 111, and the apparatus 300 as a whole, again is arranged so that the article is insertable into the second portion 111*b* of the heating zone 111 via the first portion 111*a* of the heating zone 111, when the mouthpiece 120 is disengaged from the body 110 of the apparatus 300.

In this embodiment, the first portion 111*a* of the heating zone 111 again is that which the varying magnetic field generated by the magnetic field generator 112 penetrates in use. On the other hand, the second portion 111*b* of the heating zone 111 is not penetrated by the varying magnetic field in use. That is, the varying magnetic field avoids the second portion 111*b* of the heating zone 111. The apparatus 300 is free from any magnetic field generator for generating a varying magnetic field that penetrates the second portion 111*b* of the heating zone 111. As discussed below with reference to FIG. 4, an article to be used with the apparatus 300 may comprise a heating element of heating material that is heatable by penetration with a varying magnetic field. The heating element may be arranged in the article so that, when the article is located in the heating zone 111, a first portion of the heating element of the article is located in the first portion 111*a* of the heating zone 111 and a second portion of the heating element of the article is located in the second portion 111*b* of the heating zone 111. Accordingly, a similar progressive heating effect to that discussed above could be provided, whereby in use the first portion of the heating element of the article is heated inductively and the second portion of the heating element of the article is heated by thermal conduction from the first portion of the heating element of the article.

Similarly to the discussion above regarding the relative sizes of the first and second sections 115*a*, 115*b*, 130*a*, 130*b* of the heating elements 115, 130, in this embodiment the first portion 111*a* of the heating zone 111 is smaller or shorter than the second portion 111*b* of the heating zone 111. In other embodiments, however, this may not be the case. For example, in some embodiments the first and second portions 111*a*, 111*b* of the heating zone 111 may be substantially equally sized. Again, the skilled person would be able to determine appropriate relative sizes of the first and second portions 111*a*, 111*b* of the heating zone 111 that provide for desired progressive heating of the heating element of an article and the smokable material of the article in use.

Figure 4:
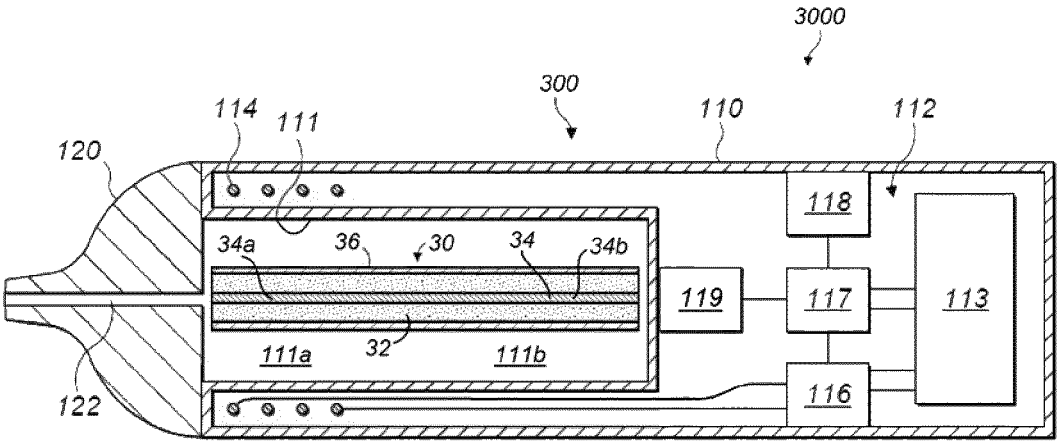
FIG. 4 shows a schematic cross-sectional view of an example of a system comprising an article comprising smokable material, and the apparatus of FIG. 3 for heating the smokable material to volatilize at least one component of the smokable material.

Referring to FIG. 4 there is shown a schematic cross-sectional view of an example of a system according to an embodiment of the disclosure. The system 3000 comprises the apparatus 300 of FIG. 3 and an article 30 comprising smokable material 32, a heating element 34 of heating material that is heatable by penetration with a varying magnetic field, and a cover 36. Therefore, in the interest of conciseness, the apparatus 300 will not be described again in detail. Any of the herein-described possible variations to the apparatus 300 of FIG. 3 may be made to the apparatus 300 of the system 3000 of FIG. 4 to form separate respective embodiments of a system.

The cover 36 encircles the smokable material 32. The cover 36 helps to protect the smokable material 32 from damage during transport and use of the article 30. During use, the cover 36 may also help to direct the flow of air into and through the smokable material 32, and help to direct the flow of vapor or aerosol through and out of the smokable material 32.

In this embodiment, the cover 36 comprises a wrapper that is wrapped around the smokable material 32 so that free ends of the wrapper overlap each other. The wrapper thus forms all of, or a majority of, a circumferential outer surface of the article 30. The wrapper may be formed from paper, reconstituted smokable material, such as reconstituted tobacco, or the like. The cover 36 of this embodiment also comprises an adhesive (not shown) that adheres the overlapped free ends of the wrapper to each other. The adhesive may comprise one or more of, for example, gum Arabic, natural or synthetic resins, starches, and varnish. The adhesive helps prevent the overlapped free ends of the wrapper from separating.

The cover 36 defines an outer surface of the article 30 and may contact the apparatus in use. In this embodiment, the article 30 is elongate and cylindrical with a substantially circular cross-section. However, in other embodiments, the article 30 may have a cross-section other than circular and/or not be elongate and/or not be cylindrical. In this embodiment, the article 30 has proportions approximating those of a cigarette.

In this embodiment, the smokable material 32 is in the form of a tube. The tube has a substantially circular cross-section. The smokable material 32 extends from one end of the article 30 to an opposite end of the article 30. Thus, in use, air may be drawn into the smokable material 32 at one end of the article 30, the air may pass through the smokable material 32 and pick up volatilized components released from the smokable material 32, and then the volatilized components, typically in the form of vapor or an aerosol, may be drawn out of the smokable material 32 at the opposite end of the article 30. In this embodiment in which the article 30 is elongate, these ends of the article 30 between which the smokable material 32 extends are opposite longitudinal ends of the article 30. However, in other embodiments, the ends may be any two ends or sides of the article, such as any two opposite ends or sides of the article.

The heating element 34 is in thermal contact with the smokable material 32. Therefore, the heating element 34 is heatable in use to heat the smokable material 32. In this embodiment, the smokable material 32 is in surface contact with the heating element 34. This is achieved by adhering the smokable material 32 to the heating element 34. However, in other embodiments, the fixing may be by other than adhesion. In some embodiments the smokable material 32 may not be fixed to the heating element 34 as such.

The heating element 34 is elongate and extends from one end of the smokable material 32 to an opposite end of the smokable material 32. This can help to provide more complete heating of the smokable material 32 in use. However, in other embodiments, the heating element 34 may not extend to either of the opposite ends of the smokable material 32, or may extend to only one of the ends of the smokable material 32 and be spaced from the other of the ends of the smokable material 32.

The heating element 34 extends from one end of the article 30 to an opposite end of the article 30. This can aid manufacturing of the article 30. However, in other embodiments, the heating element 34 may not extend to either of the opposite ends of the article 30, or may extend to only one of the ends of the article 30 and be spaced from the other of the ends of the article 30.

In this embodiment, the heating element 34 extends along a longitudinal axis that is substantially aligned with a longitudinal axis of the article 30. This can aid manufacturing of the article 30. In this embodiment, the aligned axes are coincident. In a variation to this embodiment, the aligned axes may be parallel to each other. However, in other embodiments, the axes may be oblique to each other.

In this embodiment, the heating element 34 is encircled by the smokable material 32. That is, the smokable material 32 extends around the heating element 34. In embodiments in which the heating element 34 does not extend to either of the opposite ends of the smokable material 32, the smokable material 32 may extend around the heating element 34 and also cover the ends of the heating element 34, so that the heating element 34 is surrounded by the smokable material 32.

In this embodiment, the heating element 34 is impermeable to air or volatilized material, and is substantially free from discontinuities. The heating element 34 may thus be relatively easy to manufacture. However, in variations to this embodiment, the heating element 34 may be permeable to air and/or permeable to volatilized material created when the smokable material 32 is heated. Such a permeable nature of the heating element 34 may help air passing through the article 30 to pick up the volatilized material created when the smokable material 32 is heated.

The heating element 34 has a rectangular, or substantially rectangular, cross-section perpendicular to its length. The heating element 34 has two opposing major surfaces joined by two minor surfaces. Therefore, the depth or thickness of the heating element 34 is relatively small as compared to the other dimensions of the heating element 34. However, in other embodiments, the heating element 34 may have a cross-section that is a shape other than rectangular, such as circular, elliptical, annular, polygonal, square, triangular, star-shaped, radially-finned, X-shaped, T-shaped, hollow, or perforated.

In this embodiment, the cross-section of the heating element 34 is constant along the length of the heating element 34. Moreover, in this embodiment, the heating element 34 is planar, or substantially planar. The heating element 34 of this embodiment can be considered a flat strip or ribbon. However, in other embodiments, this may not be the case. For example, in some embodiments the heating element 34 may be hollow or perforated.

In some embodiments, the heating element 34 may be non-planar. For example, the heating element 34 may follow a wavelike or wavy path, be twisted, be corrugated, be helical, have a spiral shape, comprise a plate or strip or ribbon having protrusions thereon and/or indentations therein, comprise a mesh, comprise expanded metal, or have a non-uniform non-planar shape. Such non-planar shapes may help air passing through the article to pick up the volatilized material created when the smokable material 32 is heated. Non-planar shapes can provide a tortuous path for air to follow, creating turbulence in the air and causing better heat transfer from the heating material to the smokable material 32. The non-planar shapes can also increase the surface area of the heating element 34 per unit length of the heating element 34. This can result in greater or improved Joule heating of the heating element 34, and thus greater or improved heating of the smokable material 32.

In this embodiment, the article 30 is insertable into the heating zone 111 when the mouthpiece 120 is disengaged from the body 110 of the apparatus 300. More specifically, the article 30 is insertable into the second portion 111*b* of the heating zone 111 via the first portion 111*a* of the heating zone 111, when the mouthpiece 120 is disengaged from the body 110. When the article 30 is located in the heating zone 111, a first portion 34*a* of the heating element 34 of the article 30 is located in the first portion 111*a* of the heating zone 111, and a second portion 34*b* of the heating element 34 of the article 30 is located in the second portion 111*b* of the heating zone 111. Accordingly, in use, the varying magnetic field generated by the magnetic field generator 112 that penetrates the first portion 111*a* of the heating zone 111 also penetrates the first portion 34*a* of the heating element 34. However, the varying magnetic field does not penetrate the second portion 34*b* of the heating element 34. Therefore, a similar progressive heating effect to that discussed above could be provided. That is, in use the first portion 34*a* of the heating element 34 of the article 30 is heated inductively and the second portion 34*b* of the heating element 34 of the article 30 is heated by thermal conduction from the first portion 34*a* of the heating element 34 of the article 30. This helps to enable an aerosol to be formed and released relatively rapidly from the smokable material 32 relatively close to the outlet 122, for inhalation by a user, yet provides time-dependent release of aerosol, so that aerosol continues to be formed and released even after that portion of the smokable material 32 has ceased generating aerosol.

Figure 5:
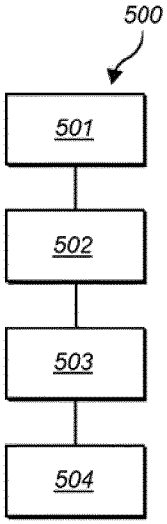
FIG. 5 shows a flow diagram showing an example of a method of heating smokable material to volatilize at least one component of the smokable material.

Referring to FIG. 5 there is shown a flow diagram showing an example of a method of heating smokable material to volatilize at least one component of the smokable material according to an embodiment of the disclosure.

The method 500 comprises providing 501 a heating element that is heatable by penetration with a varying magnetic field. The heating element could, for example, be a heating element of apparatus for heating smokable material to volatilize at least one component of the smokable material, such as the heating elements 115, 130 discussed above with reference to FIGS. 1 and 2. Alternatively, the heating element could, for example, be a heating element of an article comprising the smokable material, such as the heating element 34 discussed above with reference to FIG. 4.

The method also comprises providing 502 smokable material in thermal contact with the heating element. The smokable material could be comprised in an article, such as that shown in FIG. 4. The smokable material may be in thermal contact with the heating element as a result of the heating element also being part of the article, as is the case in FIG. 4. Alternatively, the smokable material may be placed in thermal contact with the heating element as a result of inserting smokable material into the heating zone of an apparatus comprising the heating element, as is the case in FIGS. 1 and 2.

The method further comprises penetrating 503 a first section of the heating element with a varying magnetic field that avoids a second section of the heating element, thereby to heat the first section of the heating element and a first part of the smokable material. The method may be free from any step of penetrating the second section of the heating element with a varying magnetic field.

The method also comprises heating 504 the second section of the heating element by thermal conduction from the first section of the heating element, thereby to heat a second part of the smokable material. Examples of such thermal conduction are described above. This heating 504 may comprise heating the second section of the heating element exclusively by thermal conduction from the first section of the heating element. The heating of the smokable material may be such as to volatilize at least one component of the smokable material without combusting the smokable material.

In each of the embodiments discussed above the heating material is steel. However, in other embodiments, the heating material may comprise one or more materials selected from the group consisting of: an electrically-conductive material, a magnetic material, and a magnetic electrically-conductive material. In some embodiments, the heating material may comprise a metal or a metal alloy. In some embodiments, the heating material may comprise one or more materials selected from the group consisting of: aluminum, gold, iron, nickel, cobalt, conductive carbon, graphite, plain-carbon steel, stainless steel, ferritic stainless steel, copper, and bronze. Other heating material(s) may be used in other embodiments. It has been found that, when magnetic electrically-conductive material is used as the heating material, magnetic coupling between the magnetic electrically-conductive material and an electromagnet of the apparatus in use may be enhanced. In addition to potentially enabling magnetic hysteresis heating, this can result in greater or improved Joule heating of the heating material, and thus greater or improved heating of the smokable material.

The heating material may have a skin depth, which is an exterior zone within which most of an induced electrical current and/or induced reorientation of magnetic dipoles occurs. By providing that the heating material has a relatively small thickness, a greater proportion of the heating material may be heatable by a given varying magnetic field, as compared to heating material having a depth or thickness that is relatively large as compared to the other dimensions of the heating material. Thus, a more efficient use of material is achieved and, in turn, costs are reduced.

In some embodiments, a first portion of the heating element 115, 130 may be made of a first material and a second portion of the heating element 115, 130 may be made of a second material that is different from the first material. For example, the first section 115*a*, 130*a* of the heating element 115, 130 may be made of the first material and the second section 115*b*, 130*b* of the heating element 115, 130 may be made of the second material. The first material would be a heating material that is heatable by penetration with a varying magnetic field. Examples of such heating materials are discussed above. The second material may, or may not, be a heating material that is heatable by penetration with a varying magnetic field. However, the second material should be thermally-conductive, so as to conduct heat from the first section 115*a*, 130*a* of the heating element 115, 130 in use.

In each of the above described embodiments, the smokable material comprises tobacco. However, in respective variations to each of these embodiments, the smokable material may consist of tobacco, may consist substantially entirely of tobacco, may comprise tobacco and smokable material other than tobacco, may comprise smokable material other than tobacco, or may be free from tobacco. In some embodiments, the smokable material may comprise a vapor or aerosol forming agent or a humectant, such as glycerol, propylene glycol, triacetin, or diethylene glycol.

In each of the above described embodiments, the smokable material is non-liquid smokable material, and the apparatus is for heating non-liquid smokable material to volatilize at least one component of the smokable material. In other embodiments, the opposite may be true.

In each of the above described embodiments, the article 30 is a consumable article. Once all, or substantially all, of the volatilizable component(s) of the smokable material 32 in the article 30 has/have been spent, the user may remove the article 30 from the apparatus 100, 200, 300 and dispose of the article 30. The user may subsequently re-use the apparatus 100, 200, 300 with another of the articles 30. However, in other respective embodiments, the article may be non-consumable, and the apparatus and the article may be disposed of together once the volatilizable component(s) of the smokable material has/have been spent.

In some embodiments, the apparatus 100, 200, 300 is sold, supplied or otherwise provided separately from the articles 30 with which the apparatus 100, 200, 300 is usable. However, in some embodiments, the apparatus 100, 200, 300 and one or more of the articles 30 may be provided together as a system, such as a kit or an assembly, possibly with additional components, such as cleaning utensils.

In order to address various issues and advance the art, the entirety of this disclosure shows by way of illustration and example various embodiments in which the claimed invention may be practiced and which provide for superior apparatus for heating smokable material to volatilize at least one component of the smokable material, superior systems comprising such apparatus and such articles, and superior methods of heating smokable material to volatilize at least one component of the smokable material. The advantages and features of the disclosure are of a representative sample of embodiments only, and are not exhaustive and/or exclusive. They are presented only to assist in understanding and teach the claimed and otherwise disclosed features. It is to be understood that advantages, embodiments, examples, functions, features, structures and/or other aspects of the disclosure are not to be considered limitations on the disclosure as defined by the claims or limitations on equivalents to the claims, and that other embodiments may be utilized and modifications may be made without departing from the scope and/or spirit of the disclosure. Various embodiments may suitably comprise, consist of, or consist in essence of, various combinations of the disclosed elements, components, features, parts, steps, means, etc. The disclosure may include other inventions not presently claimed, but which may be claimed in future.

The invention claimed is:

1. An apparatus for heating smokable material to volatilize at least one component of the smokable material, the apparatus comprising:

a heating zone for receiving at least a portion of an article comprising smokable material;

an outlet for permitting volatilized components of the smokable material to pass from the heating zone towards an exterior of the apparatus when the article is heated in the heating zone in use;

a heating element that is heatable by penetration with a varying magnetic field to heat the heating zone, wherein a first section of the heating element is located between a second section of the heating element and the outlet, and wherein the second section of the heating element is heatable in use by thermal conduction from the first section of the heating element; and a magnetic field generator for generating a varying magnetic field that penetrates the first section of the heating element and avoids the second section of the heating element.

2. The apparatus of claim 1, wherein the apparatus is free from any magnetic field generator for generating a varying magnetic field that penetrates the second section of the heating element.

3. The apparatus of claim 1, wherein the second section of the heating element is heatable in use exclusively by thermal conduction.

4. The apparatus of claim 1, wherein the heating element projects into the heating zone.

5. The apparatus of claim 1, wherein the heating element extends at least partially around the heating zone.

6. The apparatus of claim 1, wherein the magnetic field generator comprises a helical coil that encircles only the first section of the heating element.

7. The apparatus of claim 1, wherein the magnetic field generator is fixed relative to the heating element.

8. The apparatus of claim 1, wherein the first section of the heating element is at least one of smaller or shorter than the second section of the heating element.

9. The apparatus of claim 1, wherein the heating element comprises heating material that comprises one or more materials selected from the group consisting of: an electrically-conductive material, a magnetic material, and a magnetic electrically-conductive material.

10. The apparatus of claim 1, wherein the heating element comprises heating material that comprises a metal or a metal alloy.

11. The apparatus of claim 1, wherein the first section of the heating element is made of a first material and the second section of the heating element is made of a second material that is different from the first material.

12. The apparatus of claim 1, wherein the apparatus is for heating non-liquid smokable material to volatilize at least one component of the smokable material.

13. The apparatus of claim 12, wherein the apparatus is free from any magnetic field generator for generating a varying magnetic field that penetrates the second portion of the heating zone.

14. An apparatus for heating smokable material to volatilize at least one component of the smokable material, the apparatus comprising:

a heating zone for receiving at least a portion of an article comprising smokable material;

an outlet for permitting volatilized components of the smokable material to pass from the heating zone towards an exterior of the apparatus when the article is heated in the heating zone in use, wherein a first portion of the heating zone is located between a second portion of the heating zone and the outlet; and a magnetic field generator for generating a varying magnetic field that penetrates the first portion of the heating zone and avoids the second portion of the heating zone, wherein the apparatus is arranged so that the article is insertable into the second portion of the heating zone via the first portion of the heating zone.

15. The apparatus of claim 14, wherein the magnetic field generator comprises a helical coil that encircles only the first portion of the heating zone.

16. The apparatus of claim 14, wherein the first portion of the heating zone is at least one of smaller or shorter than the second portion of the heating zone.

17. The apparatus of claim 14, wherein the apparatus is for heating non-liquid smokable material to volatilize at least one component of the smokable material.

18. A system for heating smokable material to volatilize at least one component of the smokable material, the system comprising:

an article comprising smokable material and a heating element that is heatable by penetration with a varying magnetic field to heat the smokable material; and an apparatus, comprising:

a heating zone for receiving at least a portion of the article, an outlet for permitting volatilized components of the smokable material to pass from the heating zone when the article is heated in the heating zone in use, and a magnetic field generator for generating a varying magnetic field that penetrates a first section of the heating element between a second section of the heating element and the outlet, and avoids the second section of the heating element, when the article is located in the heating zone in use, and wherein the second section of the heating element is heatable in use by thermal conduction from the first section of the heating element.

19. A method of heating smokable material to volatilize at least one component of the smokable material, the method comprising:

providing a heating zone for receiving at least a portion of an article comprising smokable material;

providing a heating element that is heatable by penetration with a varying magnetic field to heat the heating zone;

providing smokable material in thermal contact with the heating element;

penetrating a first section of the heating element with a varying magnetic field that avoids a second section of the heating element, thereby to heat the first section of the heating element and a first part of the smokable material; and heating the second section of the heating element by thermal conduction from the first section of the heating element, thereby to heat a second part of the smokable material.

* * * * *